US012370404B2

(12) United States Patent
Brown et al.

(10) Patent No.: US 12,370,404 B2
(45) Date of Patent: Jul. 29, 2025

(54) SIMULATING A SPLIT-BELT WITH A SINGLE-BELT TREADMILL

(71) Applicants: The Board of Regents of the University of Texas System, Austin, TX (US); The University of Alabama, Tuscaloosa, AL (US)

(72) Inventors: David A. Brown, Galveston, TX (US); Chih-Ying Li, Galveston, TX (US); Mansoo Ko, Galveston, TX (US); Shengting Cao, Tuscaloosa, AL (US); Xuefeng Wang, Tuscaloosa, AL (US); Fei Hu, Tuscaloosa, AL (US); Yu Gan, Tuscaloosa, AL (US); Liang Zhang, Tuscaloosa, AL (US)

(73) Assignees: The Board of Regents of the University of Texas System, Austin, TX (US); The University of Alabama, Tuscaloosa, AL (US)

( * ) Notice: Subject to any disclaimer, the term of this patent is extended or adjusted under 35 U.S.C. 154(b) by 923 days.

(21) Appl. No.: 17/498,986

(22) Filed: Oct. 12, 2021

(65) Prior Publication Data

US 2022/0111249 A1 Apr. 14, 2022

Related U.S. Application Data

(60) Provisional application No. 63/091,145, filed on Oct. 13, 2020.

(51) Int. Cl.
*A63B 22/02* (2006.01)
*A63B 24/00* (2006.01)

(52) U.S. Cl.
CPC ..... *A63B 22/025* (2015.10); *A63B 24/0003* (2013.01); *A63B 24/0087* (2013.01)

(58) Field of Classification Search
CPC ..... A63B 22/025; A63B 24/0003; A63B 24/0087; A63B 2071/0677;
(Continued)

(56) References Cited

U.S. PATENT DOCUMENTS 9,295,302 B1 * 3/2016 Reed ..... A61H 3/00
9,526,451 B1 * 12/2016 Berme ..... A61B 5/486
(Continued)

OTHER PUBLICATIONS

International Search Report and Written Opinion for International Application No. PCT/US2021/071814 mailed Feb. 4, 2022.
(Continued)

*Primary Examiner* — Garrett K Atkinson
(74) *Attorney, Agent, or Firm* — Thomas | Horstemeyer, LLP

(57) ABSTRACT

The present disclosure presents improved treadmill control systems and methods. One such method comprises initiating a recording a video sequence of a walking exercise by a subject on a treadmill device; extracting intra-gait phases of the subject from the recorded video sequence using a video temporal alignment with a neural network; generating a series of treadmill belt control settings for the treadmill device corresponding to each phase of the gait pattern of the subject; and signaling the series of treadmill belt control settings to a motor controller of the treadmill device. Other methods and systems are also provided.

19 Claims, 8 Drawing Sheets

(58) Field of Classification Search
CPC ..... A63B 21/4009; A63B 69/0059; A63B 2024/0093; A63B 2071/0652; A63B 2220/806; A63B 2220/807; A63B 2225/20; A63B 2225/50
See application file for complete search history.

(56) References Cited

U.S. PATENT DOCUMENTS

| | | | | |
|---|---|---|---|---|
| 9,757,610 | B2 * | 9/2017 | Artemiadis | A63B 21/00181 |
| 9,763,604 | B1 * | 9/2017 | Berme | A63B 69/0053 |
| 10,117,602 | B1 * | 11/2018 | Berme | A61B 5/1128 |
| 11,806,564 | B2 * | 11/2023 | Basta | A63B 21/00181 |
| 2011/0312473 | A1 * | 12/2011 | Chu | A63B 69/0053 482/54 |
| 2015/0283422 | A1 * | 10/2015 | Piaget | A63B 22/0292 482/54 |
| 2016/0243397 | A1 * | 8/2016 | Artemiadis | A63B 21/00181 |
| 2017/0027803 | A1 * | 2/2017 | Agrawal | A61B 5/1122 |
| 2017/0128769 | A1 * | 5/2017 | Long | A61G 10/02 |
| 2020/0221975 | A1 * | 7/2020 | Basta | A63B 24/0075 |
| 2021/0291014 | A1 * | 9/2021 | Alothmany | A61B 5/6807 |
| 2022/0080284 | A1 * | 3/2022 | Churchman | A63B 22/0023 |
| 2022/0241132 | A1 * | 8/2022 | Noda | A61H 3/008 |
| 2024/0001193 | A1 * | 1/2024 | Fung | G06F 3/012 |

OTHER PUBLICATIONS

Zhe Cao et al. "Realtime Multi-Person 2D Pose Estimation using Part Affinity Fields." CVPR, pp. 7291-7299, 2017.

R. Ma et al. "An Intelligent Thermal Sensing System for Automatic, Quantitative Assessment of Motion Training in Lower-Limb Rehabilitation." IEEE Transactions on Systems, Man, and Cybernetics: Systems, 48(5), 661-669, May 2018.

D. Dwibedi et al. "Temporal cycle-consistency learning." Proceedings of the IEEE Computer Society Conference on Computer Vision and Pattern Recognition, 1801-1810, Jun. 2019.

* cited by examiner

SIMULATING A SPLIT-BELT WITH A SINGLE-BELT TREADMILL

CROSS-REFERENCE TO RELATED APPLICATION

This application claims priority to U.S. Provisional Application entitled "Simulating a Split-Belt with a Single-Belt Treadmill, having Ser. No. 63/091,145, filed Oct. 13, 2020, which is entirely incorporated by reference herein in its entirety.

STATEMENT REGARDING FEDERALLY SPONSORED RESEARCH OR DEVELOPMENT

This invention was made with government support under 1918534 awarded by National Science Foundation. The government has certain rights in the invention.

BACKGROUND

Single-belt treadmills are used by rehabilitation professionals to improve walking recovery after injury or disease. They are present in just about every physical rehabilitation-related clinic. More recently, dual-belt treadmills are being used to deliver a unique type of exercise environment that allows individuals with asymmetrical walking patterns (such as post-stroke hemiplegia, other asymmetric neurologic disorders, post-amputation, orthopedic disorders, etc.) to encourage more symmetrical walking patterns. Current treadmill control simply changes the speed/force of the treadmill in each gait cycle based on the subject's speed, measured center of pressure, step duration, or ground reaction force impulse. However, many patients have different impairment levels between the two legs. This means that in a complete gait cycle (as demonstrated by FIG. 1), each phase of the gait cycle requires attention.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

An improved treadmill control system and method is presented within the present disclosure. As discussed above, many patients have different impairment levels between the two legs. In accordance with various embodiments of the present disclosure, an exemplary treadmill control system performs a fine resolution system control in each phase of the gait cycle as a subject or patient is walking on the treadmill. While conventional treadmills have a speed or resistance control (e.g., adjustable knob(s), button(s), touch-screen controls, etc.) by which a user can manually select or adjust a speed or resistance setting that is signaled to a motor controller of the treadmill that regulates the belt speed or resistance of the treadmill, an exemplary treadmill control system can automatically signal the treadmill belt control settings, such as speed, resistance, and/or acceleration settings, to the motor speed controller of the treadmill based on a user's gait pattern in place of the conventional speed and/or resistance controls.

Figure 1:
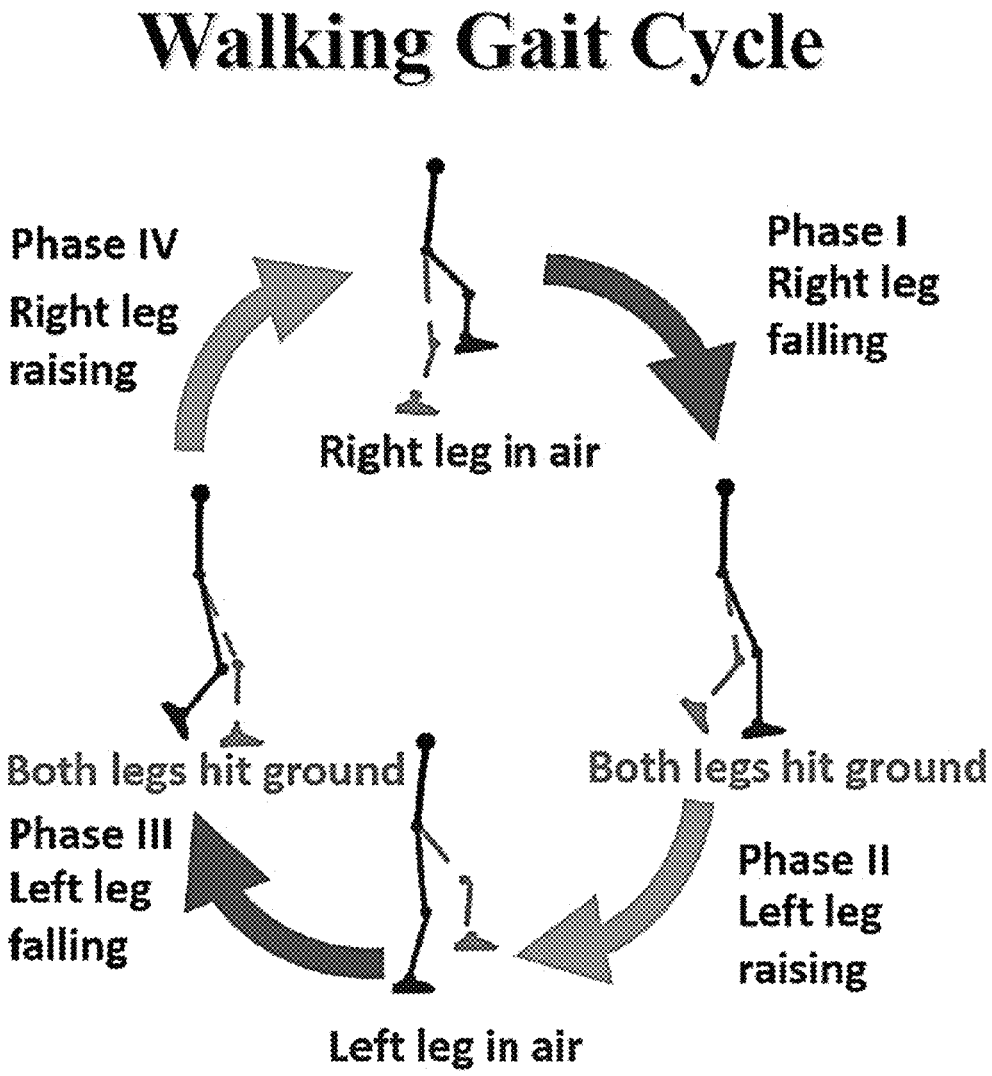
FIG. 1 shows a demonstration of a walking gait cycle in accordance with the present disclosure.

For example, FIG. 1 shows a demonstration of the walking gait cycle and the related phases. In Phase I on a treadmill, two legs are still touching the treadmill; while in Phase II, the left leg starts to leave the treadmill; and in Phase IV, the right leg leaves the ground and the left leg is still on the belt. If a patient has more serious impairment on the left leg, an exemplary treadmill control system will automatically command the treadmill belt to run with slower speed and less resistance in Phase IV (than in Phase II) of the gait cycle.

In one embodiment, a setup or configuration of the belt control settings can be learned from clinical empirical data. For example, a physical therapist (PT) could provide rehabilitation (rehab) database records and suggest a different belt speed/resistance/acceleration setting for each gait pattern (each pattern can be extracted from the captured RGB images). In accordance with embodiments of the present disclosure, cameras are used with real-time machine learning and computer vision algorithms to achieve accurate phase-by-phase rehab robot control. In various embodiments, an exemplary control system utilizes (a) a deep learning approach to achieve fast, accurate intra-gait phase classification according to spatial and temporal information of real-time video stream and (b) a treadmill controller to determine the exact treadmill belt control setting that is signaled to a motor controller of the treadmill device for each phase of the gait cycle. Such a control system can be integrated with a single-belt treadmill device.

By adding or retrofitting a new treadmill control component to a single-belt treadmill, users and operators can generate a split-belt experience on the single-belt treadmill which can be a major breakthrough in marketing rehabilitation-based treadmills. Since dual-belt treadmills are very costly (>$50K) and cost nearly three times the price of a single-belt treadmill, this innovation can provide the experience for much less cost with an existing treadmill that has already been purchased. As demonstrated by more than 70% of stroke patients have obvious differences in the impairment levels of left/right legs, the disclosed innovation meets the rehab market's needs by using leg-differentiated control. As a non-limiting example, treadmill belt control signals can be generated that will lower a value of the belt control settings during a phase of the gait pattern of the subject in which the subject's leg is in contact with a belt of the treadmill device and raise the value of the belt control settings when the subject's leg is not in contact with the belt of the treadmill device, where the value may correspond to resistance, speed, or acceleration setting for the treadmill device.

In accordance with the present disclosure, treadmill-guided gait training require precise identification of key events in the gait cycle to provide feedback to a treadmill controller about deviations from the optimal gait pattern for the subject walking or jogging on the treadmill. In accordance with various embodiments of the present disclosure, an Artificial Intelligence (AI)-enhanced treadmill controller can be utilized to precisely capture the granularity of walking patterns for people with asymmetric gait patterns (such as post-stroke hemiparetic gait patterns).

Figure 2A:
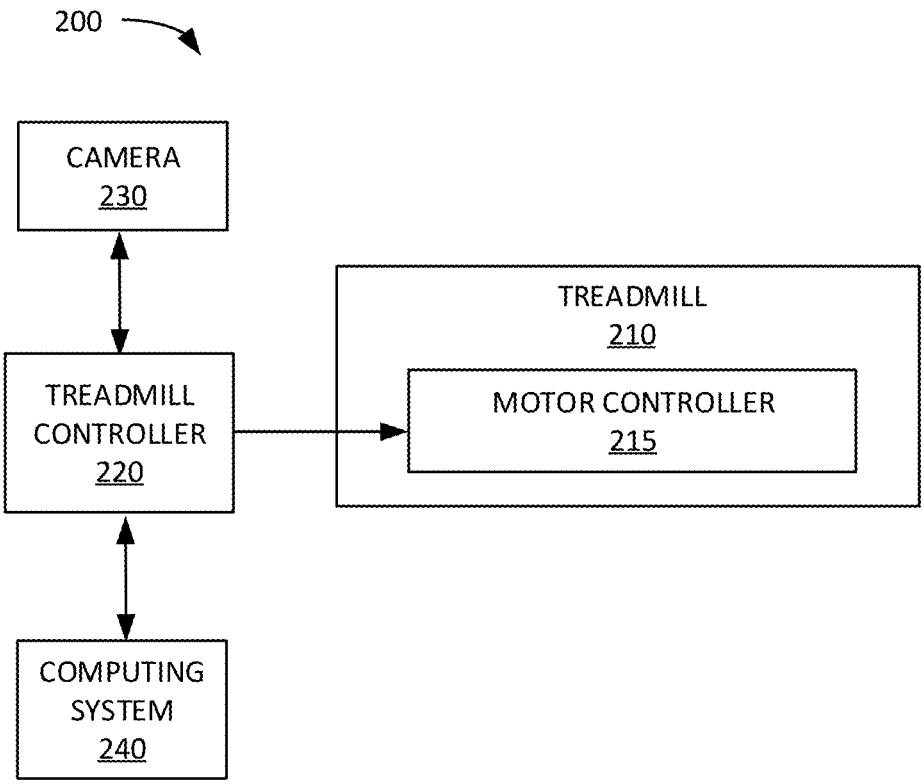
FIG. 2A shows an exemplary treadmill control system in accordance with embodiments of the present disclosure.

Referring now to FIG. 2A, an exemplary treadmill control system 200 includes a treadmill 210 having a motor controller 215 that is in electronically coupled to and receives belt control setting signals (e.g., indicating a desired speed/resistance/acceleration setting) from an exemplary treadmill controller 220. To determine the belt control settings, the exemplary treadmill controller 220 can signal a video camera 230 to capture a video recording of a subject walking on the treadmill device 210 during a training session and utilize artificial intelligence (AI) techniques of a computing device or system 240 (e.g., a neural network) to recognize the gait pattern of the subject such that the belt control settings can be adjusted to correspond to or match the unique gait pattern of the subject during a subsequent session on the treadmill device 210. In various embodiments, the treadmill controller 220 may be a component of the computing device or system 240. In alternative embodiments, the treadmill controller 220 may be independent from the computing device/system 240, while being communicatively coupled to the computing device/system 240.

Figure 2B:
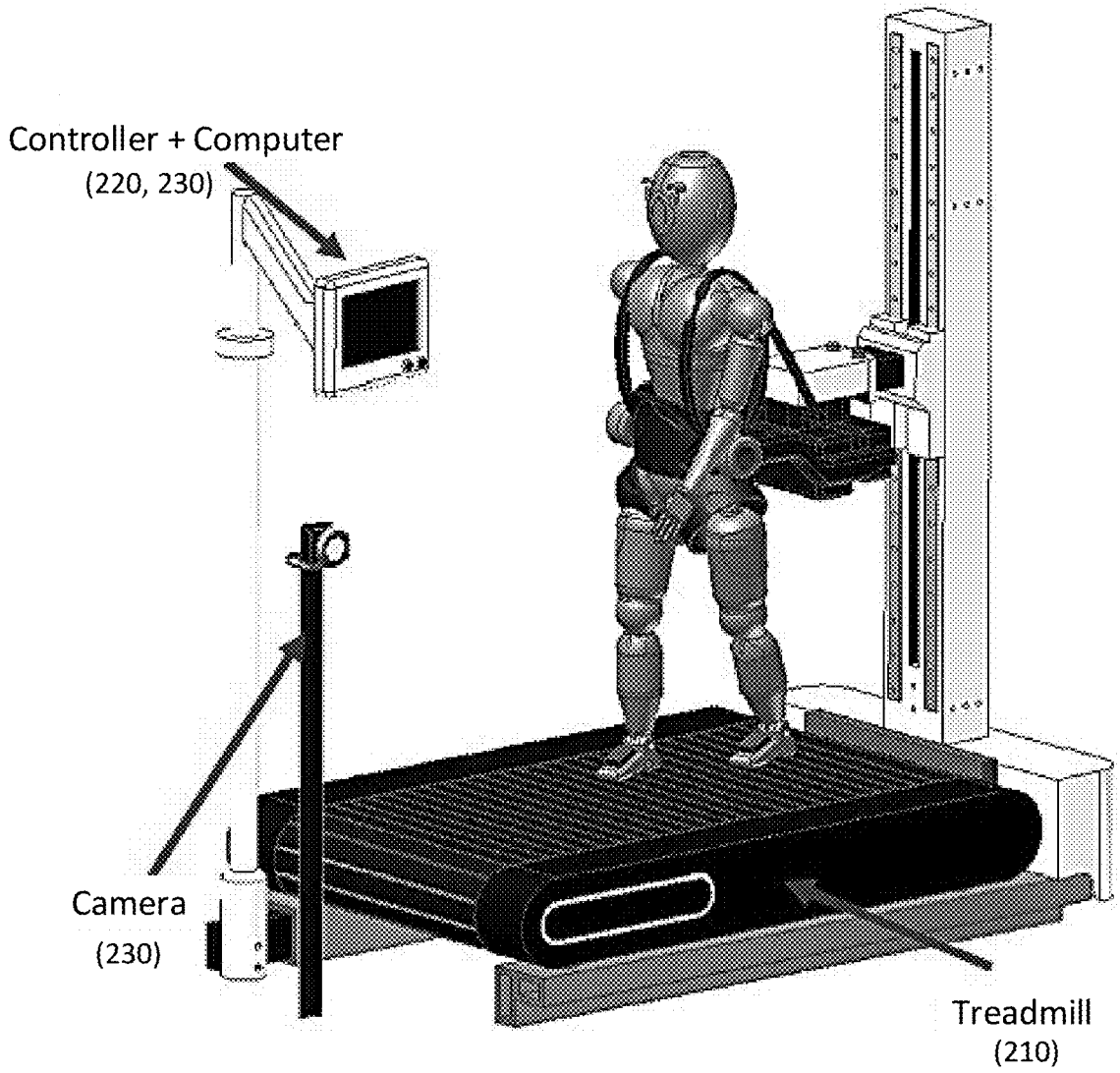
FIG. 2B shows an exemplary setup for an exemplary treadmill control system in accordance with embodiments of the present disclosure.
Figure 2C:
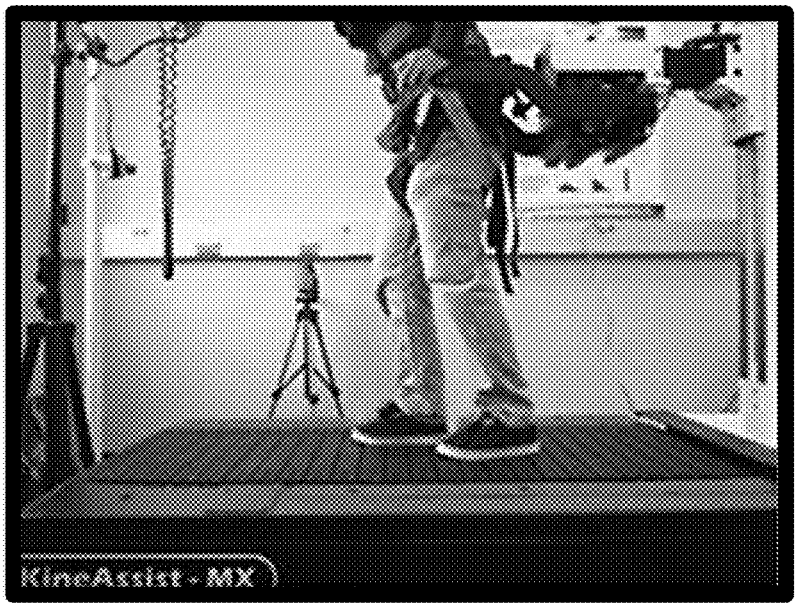
FIG. 2C shows a video image of an experimental setup for the exemplary treadmill control system of FIG. 2B.
Figure 3:
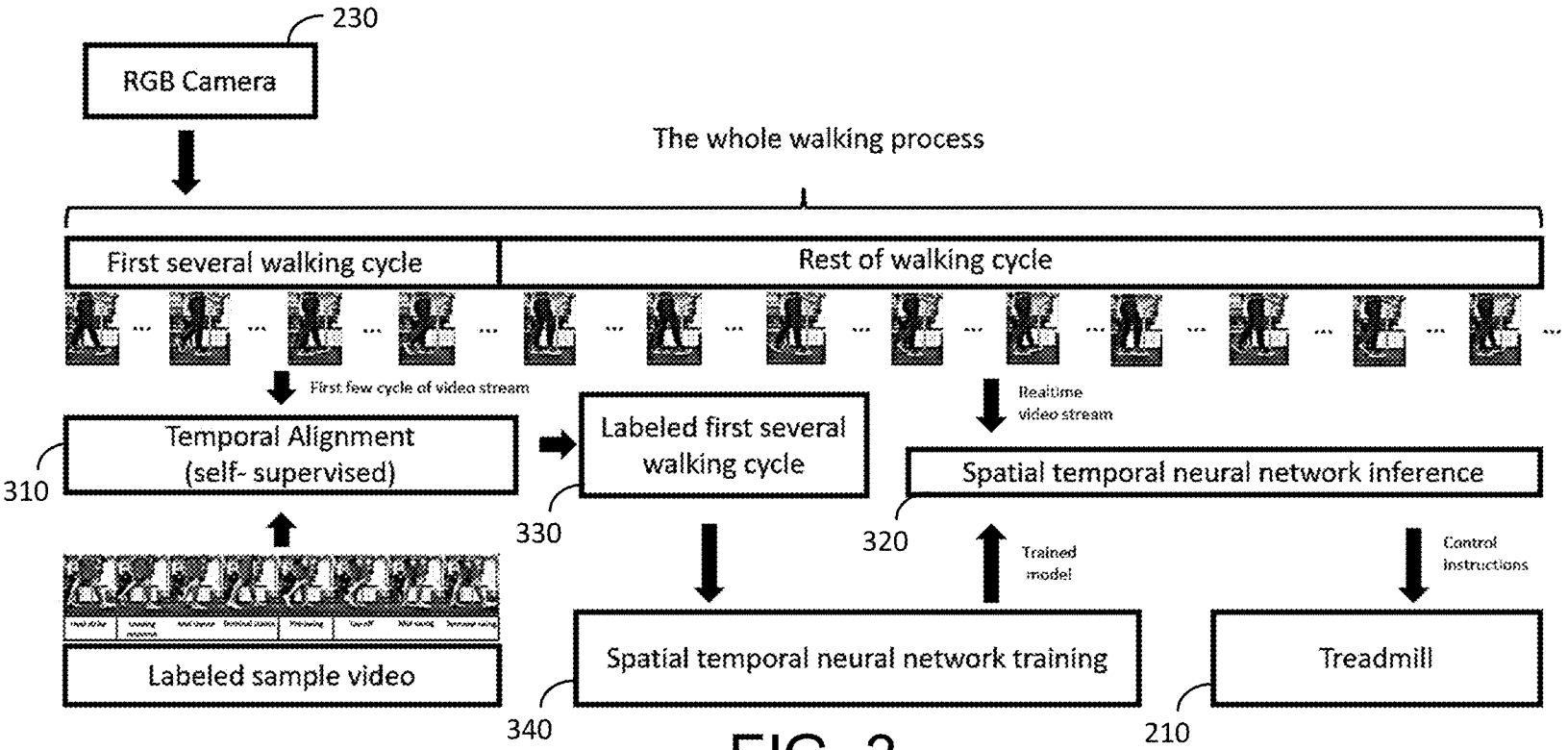
FIG. 3 shows an exemplary flow for generating a gait pattern output in accordance with embodiments of the present disclosure.
Figure 4A:
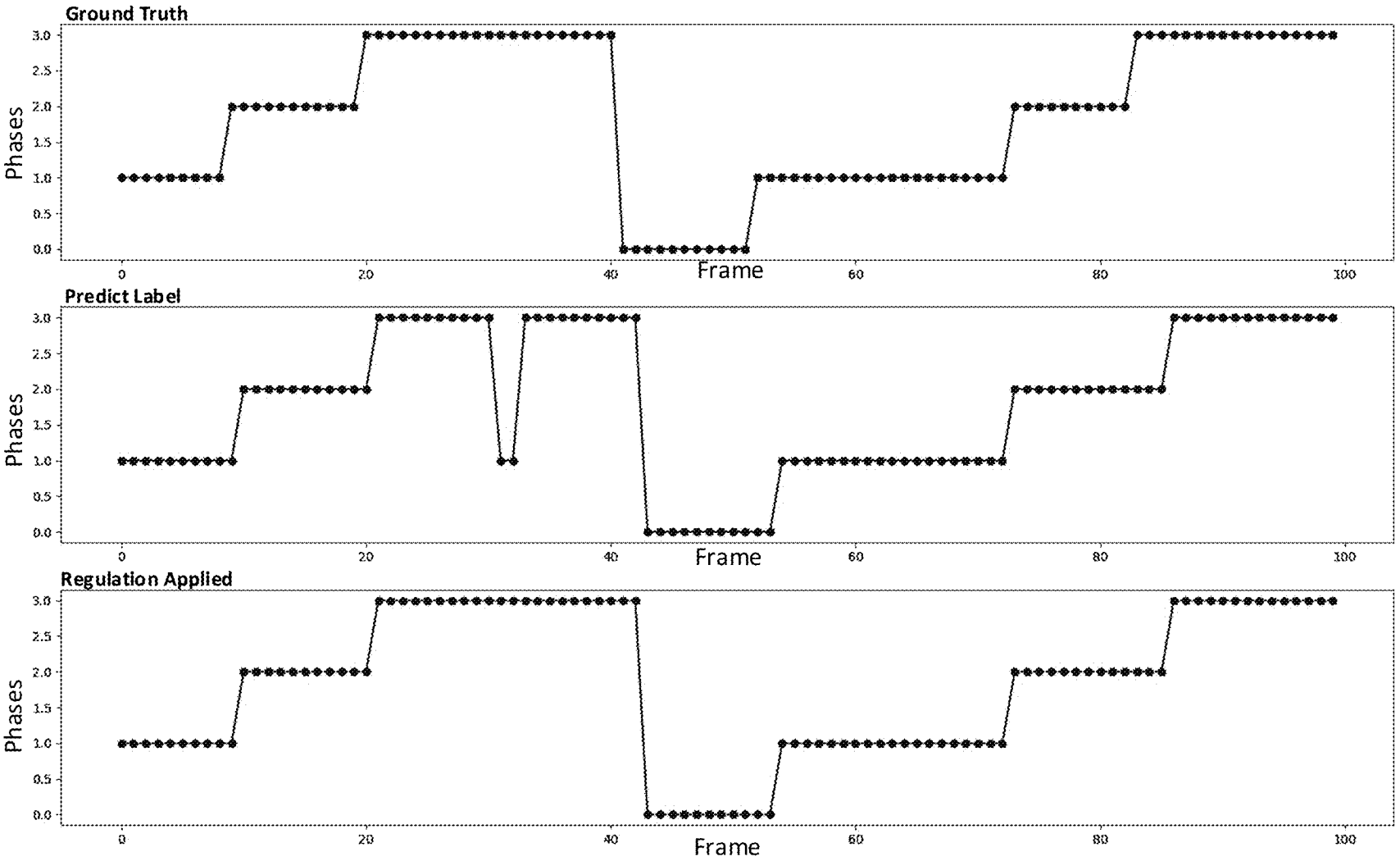
FIG. 4A shows a comparison of classifications of a gait pattern by an exemplary computing system of embodiments of the present disclosure, with the top row representing the ground truth; the second row representing a raw classification output; and the last row representing the output after regulation and removal of any outlier classifications of the gait pattern.

In one embodiment, an exemplary treadmill controller 220 and/or computing system 240 integrates a temporal alignment module 310 plus a spatial and temporal inference module 320 (as shown by FIGS. 2B and 2C). In various embodiments, the treadmill controller 220 commands or signals a camera 230 to take or capture a video recording (input image) of a subject or patient walking on the treadmill 210, as illustrated by FIG. 3, that is fed to temporal alignment and spatial and temporal interference modules 310, 320. At the temporal alignment module 310, the first few gait cycles of captured images can be used to align with pre-labeled sample videos using a self-supervised temporal alignment learning method (e.g., temporal cycle consistency alignment) implemented by the computing device/system 240 such that the first few frames of gait cycle will be labeled automatically (as indicated by block 330). Accordingly, the treadmill control system 200 can train a spatial-temporal neural network 340 of the computing device/system 240 to predict the intra-gait phases or pattern in real-time. With time series analysis, the treadmill control system 100 performs the regulation operations on each classification output to eliminate outliers, as demonstrated by the gait patterns of FIG. 4A, where the first row represents the ground truth; the second row is the raw classification output; and the last row is the output after regulation and removal of any outlier classifications of the gait pattern. Based on the classifications, intra-gait phases of the subject can be extracted and used to generate control instructions in the form of a series of treadmill belt control settings for the treadmill device 210 corresponding to each phase of the gait pattern of the subject. The control instructions may then be signaled to a motor controller of the treadmill device 210 by the treadmill controller 220.

Figure 4B:
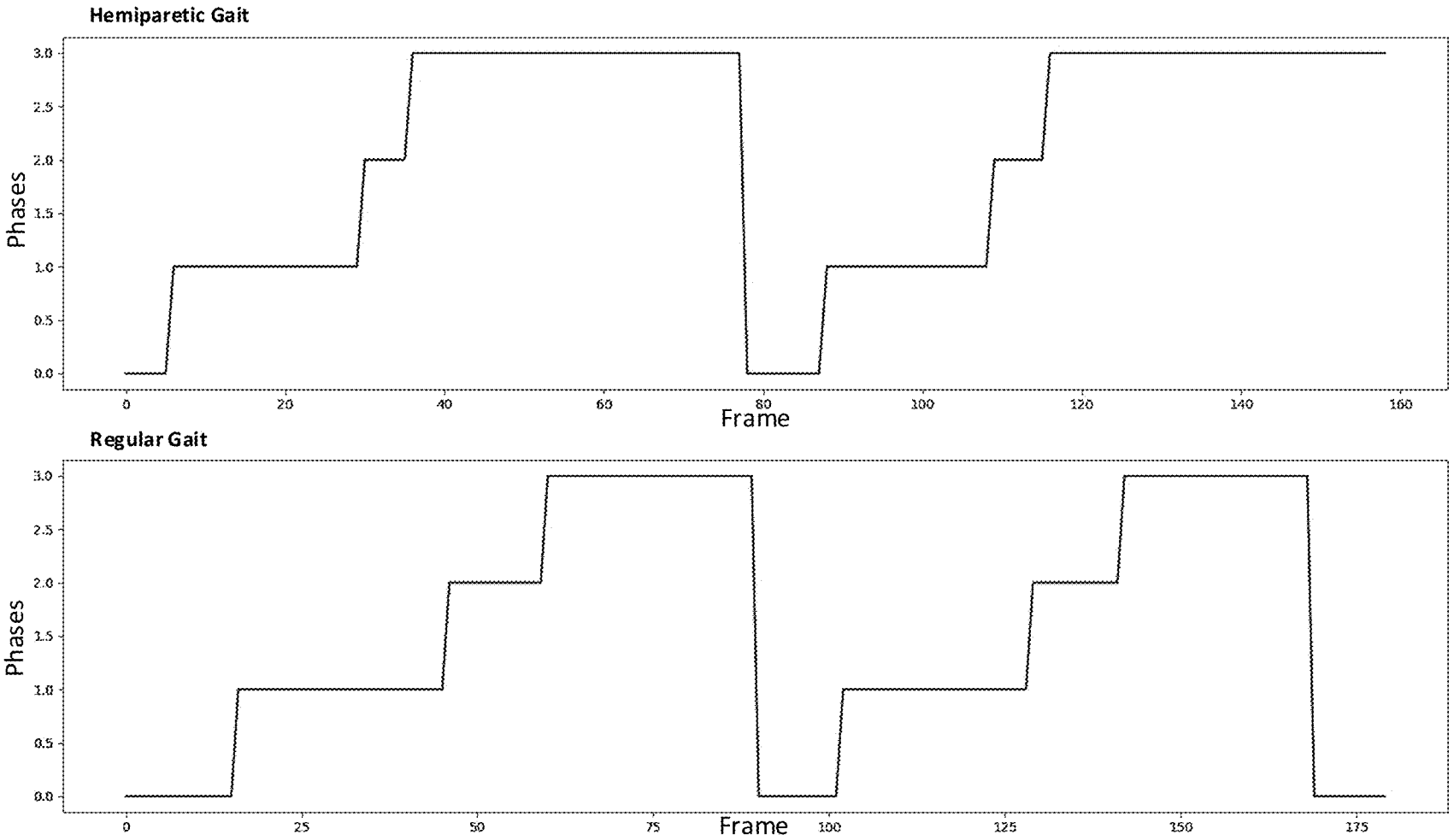
FIG. 4B shows a comparison of predicted gait patterns by an exemplary computing system of embodiments of the present disclosure with the top row representing a hemiparetic gait pattern and the bottom row representing a regular gait pattern.

Next, an experimental analysis was conducted to evaluate an exemplary embodiment of the treadmill control system and method. For the experiment, a camera 230 in the form of a Logitech C922x webcam was used to capture a video of a person's motion on a treadmill 210 and then generate the predicted gait pattern output, as shown in FIG. 4B. As a preliminary study, the exemplary method was validated on split belt treadmill in two general settings: regular gait (balanced walking) when two belts have same speed (bottom row in FIG. 4B) and hemiparetic gait (unbalanced walking) when two belts have different speed (top row in FIG. 4B).

As shown in FIG. 4B, the motion was tracked by classification results over time. By comparing the phase period, the phase 3 is prolonged compare the phase 1 in the hemiparetic gait pattern. And phase 3 and phase 1 are with the same duration in the regular gait pattern. Overall, the data formed a clear walking pattern and showed expected variations between the two walking scenarios. In addition, the analysis was performed in a real-time manner, with a rate of 19.8 (best FPS 28.5 without consider temporal information) Frame Per Second (FPS) on Intel® Core™ i7-10750H CPU @2.60 GHZ and NVIDIA GeForce GTX 1650Ti.

The foregoing experiments demonstrate the capability of an exemplary treadmill control system 200 to get accurate data of balanced and unbalanced gait in real-time. In various embodiments, AI techniques can be used to better recognize the gait patterns of patients who have difficulty walking to give immediate feedback to the treadmill control system that can assist with optimizing gait patterns during a training session. For example, treadmill belt control settings can be input as immediate feedback to the computing device during a treadmill walking exercise. In various embodiments, processing via GPU augmentation is used to increase dimensionality through a multi-camera setup, and provide a smart treadmill control to precisely capture gait information for patients with mobility impairments.

Figure 5:
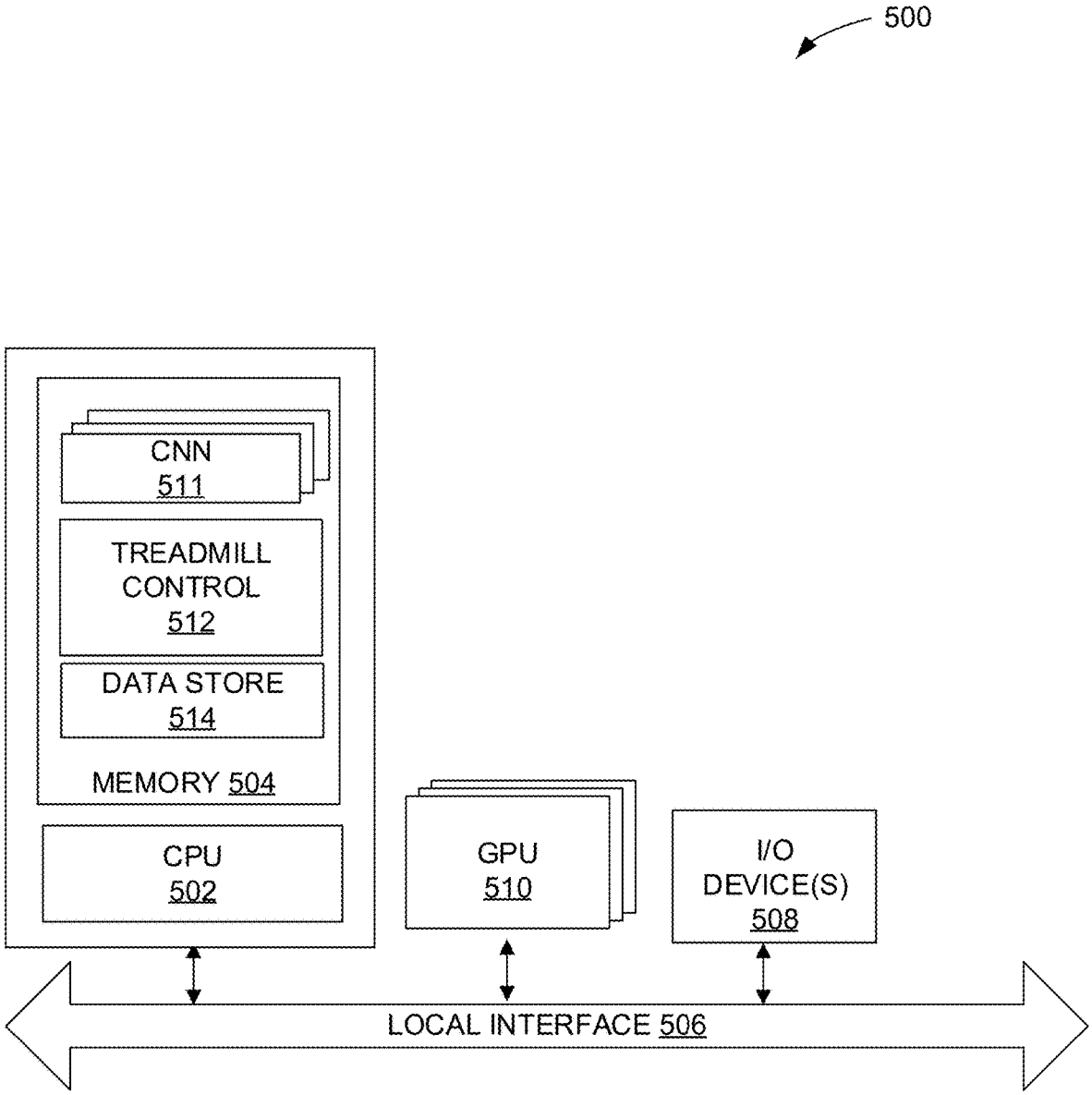
FIG. 5 depicts a schematic block diagram of a computing device that can be used to implement various embodiments of the present disclosure.

FIG. 5 depicts a schematic block diagram of a computing device 500 that can be used to implement various embodiments of the present disclosure. An exemplary computing device 500 includes at least one processor circuit, for example, having a processor 502 and a memory 504, both of which are coupled to a local interface 506, and one or more input and output (I/O) devices 508. The local interface 506 may comprise, for example, a data bus with an accompanying address/control bus or other bus structure as can be appreciated. The computing device 500 further includes Graphical Processing Unit(s) (GPU) 510 that are coupled to the local interface 506 and may utilize memory 504 and/or may have its own dedicated memory. The CPU and/or GPU(s) can perform various operations such as image enhancement, graphics rendering, image/video processing, recognition (e.g., text recognition, object recognition, feature recognition, etc.), image stabilization, machine learning, filtering, image classification, and any of the various operations described herein.

Stored in the memory 504 are both data and several components that are executable by the processor 502. In particular, stored in the memory 504 and executable by the processor 502 are code for implementing one or more convolutional neural network (CNN) model(s) 511 and/or treadmill control code for extracting gait patterns & generating signaling belt control settings or commands 512. Also stored in the memory 504 may be a data store 514 and other data. The data store 514 can include an image database for video recordings, and potentially other data. In addition, an operating system may be stored in the memory 504 and executable by the processor 502. The I/O devices 508 may include input devices, for example but not limited to, a keyboard, touchscreen, mouse, one or more cameras and/or sensors, etc. Furthermore, the I/O devices 508 may also include output devices, for example but not limited to, speaker, earbuds, audio output port, a printer, display, Bluetooth output module, etc.

Certain embodiments of the present disclosure can be implemented in hardware, software, firmware, or a combination thereof. If implemented in software, the treadmill control logic or functionality are implemented in software or firmware that is stored in a memory and that is executed by a suitable instruction execution system. If implemented in hardware, the treadmill control logic or functionality can be implemented with any or a combination of the following technologies, which are all well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

It should be emphasized that the above-described embodiments are merely possible examples of implementations, merely set forth for a clear understanding of the principles of the present disclosure. Many variations and modifications may be made to the above-described embodiment(s) without departing substantially from the principles of the present disclosure. All such modifications and variations are intended to be included herein within the scope of this disclosure.

Therefore, at least the following is claimed:

1. A method comprising:

initiating, by a computing device, a recording of a video sequence of a walking exercise by a subject on a treadmill device;

extracting, by the computing device, intra-gait phases of the subject from the recorded video sequence using a video temporal alignment with a neural network;

generating, by the computing device, a series of treadmill belt control settings for the treadmill device corresponding to each intra-gait phase of a gait pattern of the subject; and signaling, by the computing device, the series of treadmill belt control settings to a motor controller of the treadmill device.

2. The method of claim 1, wherein the treadmill device comprises a single-belt treadmill device.

3. The method of claim 1, wherein the computing device comprises a convolutional neural network device.

4. The method of claim 1, wherein the subject has an asymmetric gait pattern.

5. The method of claim 1, wherein the series of belt control settings are configured to lower a value of the belt control settings during an intra-gait phase of the gait pattern of the subject in which the subject's leg is in contact with a belt of the treadmill device and raise a value of the belt control settings when the subject's leg is not in contact with the belt of the treadmill device.

6. The method of claim 5, wherein the treadmill device comprises a single-belt treadmill device.

7. The method of claim 1, wherein the subject has an impaired leg resulting in an asymmetric gait pattern, wherein the series of belt control settings are configured to slow down the treadmill device during an intra-gait phase of the gait pattern of the subject in which the subject's impaired leg is in contact with a belt of the treadmill device and increase a speed of the treadmill device when the subject's impaired leg is not in contact with the belt of the treadmill device.

8. The method of claim 1, wherein the series of treadmill belt control settings are input as feedback to the computing device during the walking exercise.

9. The method of claim 1, wherein the intra-gait phases of the subject are extracted using temporal alignment and a self-supervised learning scheme during the walking exercise.

10. The method of claim 1, wherein the treadmill belt control settings configure a speed setting and an acceleration setting for a motor controller of the treadmill device.

11. A treadmill control system comprising:

a memory of a computing device; and a hardware processor of the computing device operatively coupled to the memory, wherein the hardware processor is configured to:

obtain a video sequence of a walking exercise by a subject on a treadmill device;

extract intra-gait phases of the subject from the video sequence using a video temporal alignment with a neural network;

generate a series of treadmill belt control settings for the treadmill device corresponding to each intra-gait phase of a gait pattern of the subject; and signal the series of treadmill belt control settings to a motor controller of the treadmill device.

12. The treadmill control system of claim 11, further comprising the treadmill device and one or more video cameras for recording the video sequence.

13. The treadmill control system of claim 12, wherein the treadmill device comprises a single-belt treadmill device.

14. The treadmill control system of claim 11, wherein the computing device comprises a convolutional neural network device.

15. The treadmill control system of claim 11, wherein the computing device is configured to input the series of treadmill belt control settings as feedback to the computing device during the walking exercise.

16. The treadmill control system of claim 11, wherein the intra-gait phases of the subject are extracted using temporal alignment and a self-supervised learning scheme during the walking exercise.

17. The treadmill control system of claim 11, wherein the treadmill belt control settings configure a speed setting and an acceleration setting for a motor controller of the treadmill.

18. The treadmill control system of claim 11, wherein the series of belt control settings are configured to lower a value of the belt control settings during an intra-gait phase of the gait pattern of the subject in which the subject's leg is in contact with a belt of the treadmill device and raise the value of the belt control settings when the subject's leg is not in contact with the belt of the treadmill device.

19. The treadmill control system of claim 18, wherein the value of the belt control settings comprises a value for a speed or acceleration setting.

* * * * *